US006517191B1

(12) United States Patent
Koitabashi

(10) Patent No.: US 6,517,191 B1
(45) Date of Patent: Feb. 11, 2003

(54) INK JET PRINTING APPARATUS AND INK JET PRINTING METHOD

(75) Inventor: Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,913

(22) Filed: Jul. 5, 2000

(30) Foreign Application Priority Data

Jul. 5, 1999 (JP) ..... 11-190579

(51) Int. Cl.[7] ..... B41J 2/21

(52) U.S. Cl. ..... 347/43; 347/15; 347/98; 347/100

(58) Field of Search ..... 347/15, 43, 42, 347/98, 96, 100, 14

(56) References Cited

U.S. PATENT DOCUMENTS

| | | | | |
|---|---|---|---|---|
| 5,568,169 A | * | 10/1996 | Dudek et al. | 347/43 |
| 5,581,284 A | * | 12/1996 | Hermanson | 347/41 |
| 5,853,465 A | * | 12/1998 | Tsang | 106/31.26 |
| 5,933,164 A | * | 8/1999 | Sato et al. | 347/43 |
| 6,062,674 A | * | 5/2000 | Inui et al. | 347/43 |
| 6,074,052 A | | 6/2000 | Inui et al. | 347/101 |
| 6,123,411 A | * | 9/2000 | Inui et al. | 347/43 |
| 6,137,507 A | * | 10/2000 | Inui et al. | 347/43 |
| 6,158,834 A | * | 12/2000 | Kato et al. | 347/43 |

FOREIGN PATENT DOCUMENTS

| | | |
|---|---|---|
| EP | 0 802 060 A2 | 10/1997 |
| EP | 0 858 900 A2 | 8/1998 |
| EP | 0 925 919 A2 | 6/1999 |
| JP | 8-281974 | 10/1996 |

* cited by examiner

*Primary Examiner*—Lamson Nguyen
(74) *Attorney, Agent, or Firm*—Fitzpatrick, Cella, Harper & Scinto

(57) ABSTRACT

To provide an ink jet printing apparatus that can realize fast printing based on fast fixing and that can print high density black characters with little feathering and images with little bleeding at a boundary between colors. More specifically, a black ink is applied to a printing medium and a processing liquid is then applied to the black ink to mix the black ink and the processing liquid together on the printing medium in a liquid state. After reaction resulting from the mixture of the black ink and the processing liquid, color inks are applied to an area of the printing medium to which the black ink and the processing liquid are not applied. Accordingly, a reactant between the black ink and the processing liquid or the black ink becomes insoluble and thus is prevented from flowing out to peripheries of the image, thereby reducing bleeding at the boundary between a color image and a black image as may occur when the color ink is applied to the peripheries.

30 Claims, 6 Drawing Sheets

INK JET PRINTING APPARATUS AND INK JET PRINTING METHOD

This application is based on Patent Application No. 11-190579 (1999) filed Jul. 5, 1999 in Japan, the content of which is incorporated hereinto by reference.

BACKGROUND OF THE INVENTION

1. Field of the Invention

The present invention relates to an ink jet printing apparatus and an ink jet printing method, and particularly to an ink jet printing apparatus and an ink jet printing method for performing printing using a processing liquid that makes inks insoluble.

2. Description of the Prior Art

Ink jet printing apparatuses, which have advantages such as their capability of simple printing on various printing mediums, are enjoying more and more applications due to their improved print quality. Ink jet printers are not only used personally but also in offices in order to output various types of information, for example. The ink jet printing apparatuses are what are also used as printout apparatuses in facsimile machines, copy machines, and word processors or the like.

Thus, the ink jet printing apparatuses are further desired to provide a higher image quality. Specifically, it is desirable that printed characters such as black letters have high density and have sharp edges without feathering, that is, bleeding in a form of whiskers. In addition, in printing color images, bleeding is desirably prevented at boundaries between colors.

Some conventional methods, which increase the density (for example, OD: optical density) of black characters and form an image with sharp edges, use ink as a black (Bk) ink, what is called a remaining upper part-type ink, which permeates through a plain paper at a relatively low speed so that a coloring material remain at a upper part (shallower part) of a printing medium.

A problem with the use of such an remaining upper part-type ink of Bk, however, is that due to its insufficient fixing capability (permeability), a relatively long time is required to eject printed paper and obtain a printed product, especially to fix the printed image when solid images which have a particularly high duty are printed.

On the other hand, highly permeable inks have generally been used in order to prevent ink from bleeding at boundaries between colors in color images. In this case, however, when the Bk ink is also highly permeable, it is disadvantageously impossible to increase the density of black characters as described above or other problems may result in. In order to solve this problem, a remaining upper part-type Bk ink of lower permeability is used, while the other color inks are highly permeable. Additionally, the bleeding at the boundaries is prevented by allowing the Bk and color inks to be ejected in accordance with a fixed or more amount of time difference, or for the boundaries, by using a process black obtained through compounding from color inks. In this case, however, when printing black characters or the like, it may be caused that a fixing speed of the ink to the printing medium becomes lower and then printing with high speed can not be performed. The fast printing is desired particularly in the case that the ink jet printing apparatus used in offices.

In addition, a known means for improving, in particular, the fixing capability provides heaters along a paper feed path to evaporate moisture from the inks in order to promote fixation. This configuration enables faster fixing which contributes to faster printing.

As is apparent from the above description, it is relatively difficult for the conventional techniques to print high-grade black characters or the like and perform printing without bleeding at the boundaries between colors, with a relatively high speed. More specifically, a mere change in Bk ink permeability does not allow these problems to be simultaneously solved, particularly because there is a tradeoff relationship between the printed character grade such as the density and the fixing capability. This, in turn, can not provide a sufficient solution to the problem of bleeding at the boundaries.

The method of allowing the inks to be ejected at different points of time or using the process black as described above has difficulties in realizing fast printing. In addition, the method of using the heaters for fixing is not practical because more thermal energy is required to achieve fast printing.

The assignee of the present application has proposed use of a processing liquid for making color materials in ink insoluble, in order to improve the above-described black character grade or to improve color-developing capability. For example, the processing liquid is ejected before ejection of the ink so that the processing liquid reacts with the ink ejected after and much color material in the ink remains on a surface of the paper, thereby increasing the density and the color-developing capability and preventing feathering from occurring. In this case, the processing liquid with a relatively low permeation speed is conventionally used to create a pool of the processing liquid on the paper so that the ink can be applied to this pool. The ink thereby reacts on a surface of the paper as described above.

Disadvantageously, however, the use of the processing liquid with a low permeation speed is unsuitable for fast printing.

SUMMARY OF THE INVENTION

The object of the present invention is to provide an ink jet printing apparatus and an ink jet printing method that can realize fast printing based on fast fixing and that can print black characters with high density and little feathering and images with little bleeding at boundaries between colors.

Another object of the present invention is to provide an ink jet printing apparatus and an ink jet printing method that can achieve the above object and that can solve a problem that may occur when a head of a large printable width is used.

The problem caused by the use of the head of large width is an increase in temperature associated with continuous printing. When high-duty printing is continuously carried out, for example, the width of the head becomes longer to shift a landing position of the ink from a normal one. In the case that a plurality of heads are used for the inks and the processing liquid as described above, the landing position may vary among the heads, that is, a misregistration problem may occur.

Thus, it is another object of the present invention to avoid the misregistration between the inks and the processing liquid in order to achieve the above-described objects such as high-quality printing.

In a first aspect of the present invention, there is provided an ink jet printing method of performing printing by applying to a printing medium, an ink and a processing liquid for making a coloring material in the ink insoluble, the method comprising the steps of:

applying a black ink containing a black coloring material and the processing liquid to the printing medium to mix the black ink and the processing liquid together in a liquid state on the printing medium, and applying, with a timing different from that for a reaction resulting from the mixture of the black ink and the processing liquid, a color ink to an area of the printing medium to which the black ink and the processing liquid are not applied.

In a second aspect of the present invention, there is provided an ink jet printing apparatus which uses a head for ejecting an ink and a head for ejecting a processing liquid for making a coloring material in the ink insoluble to perform printing by ejecting to a printing medium the ink and the processing liquid, the apparatus comprising:

ejection control means for ejecting a black ink containing a black coloring material and the processing liquid to the printing medium to mix the black ink and the processing liquid together in a liquid state on the printing medium, and for ejecting, with a timing different from that for a reaction resulting from the mixture of the black ink and the processing liquid, a color ink to an area of the printing medium to which the black ink and the processing liquid are not ejected.

With this configuration, for example, the black ink is applied to the printing medium and the processing liquid is then applied so as to mix the black ink and the processing liquid together on the printing medium in a liquid state, and with a timing different from that for the reaction resulting from the mixture of the black ink and the processing liquid, for example, after the reaction, the color inks are applied to an area of the printing medium to which the black ink and the processing liquid are not applied. Thus, a reactant between the black ink and the processing liquid or the black ink becomes insoluble so as to be prevented from flowing out to the peripheries thereof, thereby reducing bleeding at the boundary between a color image and a black image even when the color ink is applied to the peripheries That is, when before the black ink becomes insoluble, the processing liquid or another ink is applied to the peripheries of the black ink, a liquid which has not become completely insoluble may flow out, but the present invention can prevent such a phenomenon.

In addition, when the processing liquid and the color inks are that permeate at a high speed, the black and color images can be printed with high fixing capability.

The above and other objects, features and advantages of the present invention will become more apparent from the following description of embodiments thereof taken in conjunction with the accompanying drawings.

DESCRIPTION OF THE PREFERRED EMBODIMENT

Embodiments of the present invention will be described below in detail with reference to the drawings.

In a process to obtain embodiments of the present invention, the inventor carried out the following examinations and experiments.

First, the remain upper part-type (low permeation speed) Bk(black) ink was used and was applied to a paper as a printing medium, and a given time later, the processing liquid of a relatively high permeability was applied to the Bk ink in an overlapping manner. When only black images such as black characters are printed under this condition, fast printing can be achieved with a high OD and little feathering.

Figure 1A:
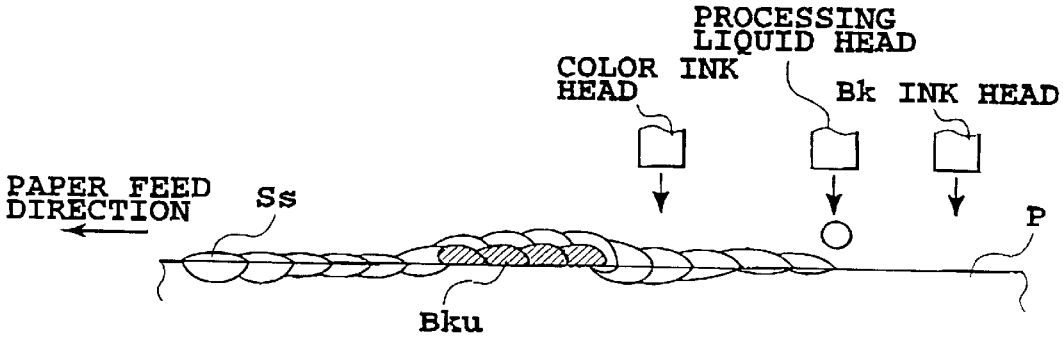
FIGS. 1A, 1B and 1C are diagrams for describing bleeding occurring at a boundary between a black image and a color image in a conventional example.
Figure 1B:
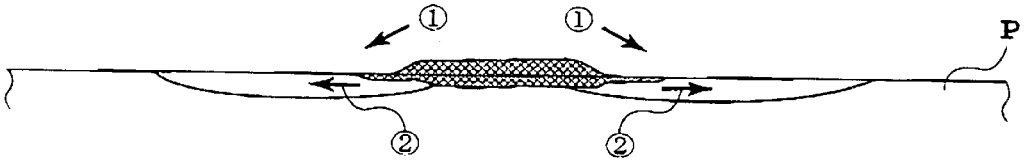
Figure 1C:
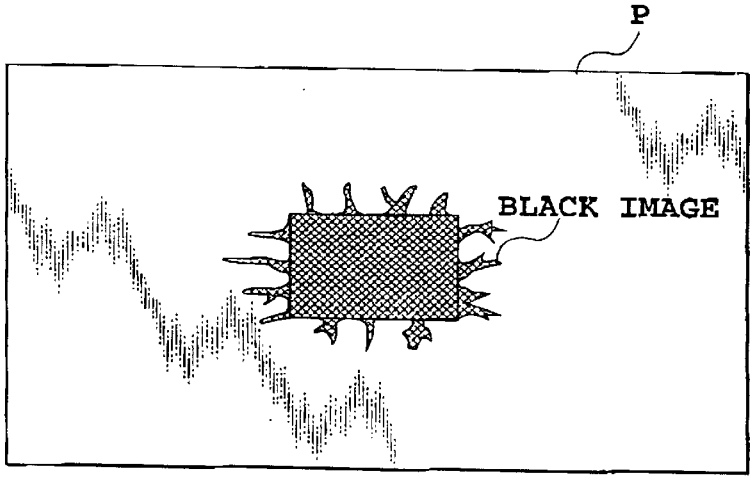

On the other hand, a color image was printed around and adjacent to a area on which the black (Bk) image was printed under the above conditions. In this case, color inks (for example, cyan (C), magenta (M), and yellow (Y) inks) had a relatively high permeability for fast fixing. The dot-on-dot relationship was established between the processing liquid and the color inks, as with the Bk ink. FIGS. 1A, 1B and 1C are diagrams schematically showing results of the described printing. In these figures, illustration of the color inks is omitted.

As shown in FIG. 1C, some of the printing results showed that the black image was subjected to bleeding in a form of whiskers. Results of the examinations by the inventor indicate that this bleeding occurs as described below.

As shown in FIG. 1A, the processing liquid Ss is applied to respective whole pixels to which the Bk and color inks have been applied respectively. Thus, a reactant between the previously applied Bk ink and the processing liquid or the Bk ink Bku is fluidized so that a part of the Bk image collapses like an avalanche, as an arrow ① shown in FIG. 1B. At this point of time, as shown in FIG. 1B, the processing liquid has already permeated through the periphery of the black image, so that the reactant or the ink collapsed as described above flows over a surface layer portion of the paper as an arrow ② shown in FIG. 1B. Then, along the passage of the flow, the reactant or the ink further flows into the periphery of the image. As a result, bleeding in the form of whiskers occurs.

As described above, in an image with black and color images mixed therein, bleeding, which is not preferable for the image quality, may occur. In addition to this, when only the color image is evaluated, it is observed that OD of the color image is low and developed color the color image is dull compared to the image without applying the processing liquid before the color ink.

The reason will be shown below. At the time when the color ink is applied, the processing liquid has already permeated into the paper due to its relatively high permeation speed, so that almost no processing liquid is present on the surface of the paper. As a result, the color ink reacts principally with the processing liquid inside the paper.

Figure 2A:
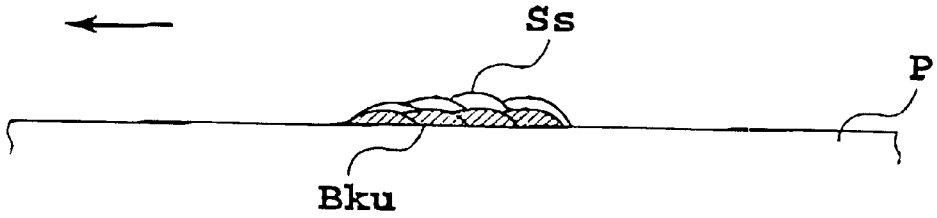
FIGS. 2A, 2B and 2C are diagrams for describing how the bleeding at the boundary is reduced according to an embodiment of the present invention.
Figure 2B:
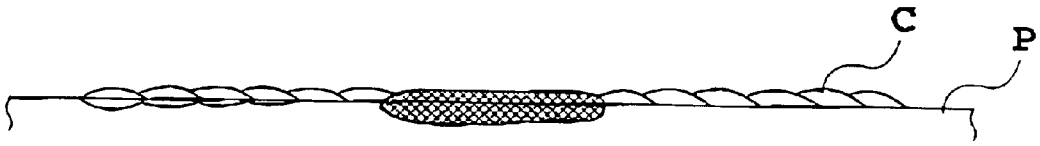

In this embodiment, as shown in FIG. 2A, the Bk ink Bku is of the remain upper part-type and after a given time elapsed from applying the Bk ink Bku the highly-permeable processing liquid Ss is applied to the Bk ink Bku in an overlapping manner to print a black image. On the other hand, to print a color image, the processing liquid is not applied to the pixels to which the color ink C is to be applied and only the color ink C is applied, as shown in FIG. 2B.

Figure 2C:
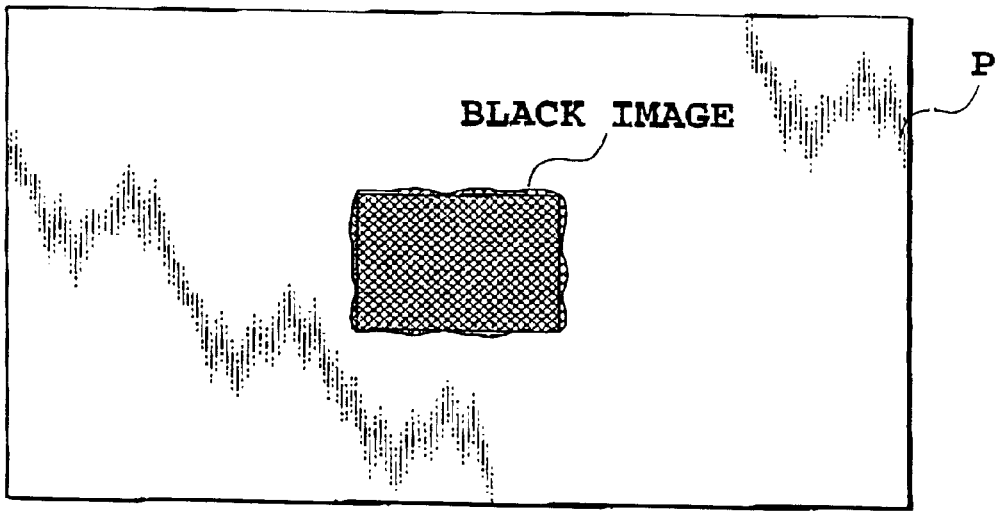

The black image printed in the above manner has sharp edges without bleeding as shown in FIG. 2C and can be fixed in a relatively short time. In addition, the color image thus obtained is clear and has a relatively high OD and little bleeding at the boundary between itself and a black image. Thus, according to this embodiment, in printing an image with black and color images mixed therein, a generally high-grade image can be printed and printing can be performed with a high fixing speed.

Similar results were obtained when the above method was applied to what is called a full-line head having ink ejection openings arranged in a fashion corresponding to the width of paper to be fed. More specifically, identical ejection data is used both for the Bk ink and for the processing liquid, that is, the processing liquid is applied whenever the Bk ink is applied. Then, even if the duty is relatively high and the head thus becomes hot to be elongated, the Bk and color heads tend to be elongated in almost the same manner, so that a possible relative deviation of the landing position between the ink and the processing liquid can be minimized. In this manner, even with the full-line head and high-duty printing, high-grade images can be printed with the high fixing speed.

Although in the above description, the identical ejection data is used both for the Bk ink and for the processing liquid, the application of the present invention is not limited to this example. That is, the ejection data for the Bk ink and for the processing liquid may be different as long as the above-described deviation of the landing position does not significantly affect the image quality.

The embodiments based on the above examinations will be explained below.

(Embodiment 1)

A first embodiment of the present invention uses a dye as a coloring material in the Bk ink. Then, identical election data is used both for the Bk ink and for the processing liquid. That is, the processing liquid is ejected onto the Bk ink on the dot-on-dot basis. On the other hand, upon printing a color image by selectively ejecting the Y, M, and C inks, the processing liquid is not ejected onto these inks. These inks and the processing liquid are ejected in an order of the Bk ink, the processing liquid, and the color inks. The color inks may be ejected in an arbitrary order, for example, in the order of C, M, and Y. In addition, coloring materials for the color inks are dyes.

It should be noted that the ejection order of the Bk ink, the processing liquid, and the color inks is not limited to the above example. It is arbitrary unless applying the color inks does not affect the reaction between the Bk ink and the processing liquid. For example, the color inks may be applied before applying the Bk ink and the processing liquid.

As to permeability, the Bk ink used is that has lower permeability than the processing liquid has, and the processing liquid used is that permeates at relatively high speed. Thus, the Bk ink and the processing liquid react to each other before most of them have permeated, so that the dye constituting the color material of the Bk ink becomes insoluble, whereas a solvent or the like containing water permeates through the paper at a high speed due to its high permeability. As a result, black images with a high OD and sharp edges can be obtained without bleeding and fixed in a short time.

On the other hand, since the processing liquid is not applied to the printed portions of the color images. the dyes constituting the color materials of the color inks are prevented from reacting to the processing liquid after permeating through the paper as described above. Consequently, images with appropriately developed colors are obtained while precluding a significant decrease in OD. In addition, due to the high permeability of each color ink, the bleeding at the boundary between the color images is not so noticeable.

Furthermore, little bleeding occurs at the boundary between the black and color images because the Bk ink has become insoluble due to its reaction with the processing liquid and because no processing liquid is present around the black image as described above.

In addition to the above effects, this embodiment can provide following effects: First, since no processing liquid is applied to the color inks, only a small amount of the ink and the processing liquid must be applied to the overall paper, thereby restraining the paper from being curled or cockled.

Additionally, since the processing liquid does not need to be ejected onto the color inks, the use frequency of the head for ejecting the processing liquid can be reduced to improve its durability. For example, in a type of heads that eject ink using thermal energy generated by heaters, the durability of the heaters is improved. This is advantageous for fast printers responsible for a large amount of printing.

Furthermore, since the identical ejection data is used both for the processing liquid and for the Bk ink, loads for image processing required to obtain these data can be decreased, and also the processing is improved to be faster.

Although the above-described embodiment uses the dye as the coloring material of the Bk ink, the present invention is not limited to this example For example, a pigment can be used as the coloring material. In this case, a dispersing agent-free pigment is more preferable in terms of reliability including the wettability of a print head face. Alternatively, instead of a single dye or pigment, a mixture of a dye and a pigment may be used. In particular, a mixture of a pigment and a dye serves to achieve a higher OD and faster fixing than a single pigment or dye. In this case, the mixed ink may be obtained by ejecting pigment and dye inks from separate heads or a single head and mixing these inks on the paper, or may contain previously mixed color materials.

Additionally, although in the above embodiment, the processing liquid is applied after applying the Bk ink, the Bk ink may be further applied after applying the processing liquid. Further, an applying order that the processing liquid is applied before the Bk ink is applied may be used as one applying order of the Bk ink and the processing liquid. Also, this configuration can be applied to other embodiments described below.

In the above embodiment, when the Bk ink and the processing liquid react to each other to make the ink color material insoluble, the ink and the processing liquid does not need to have fixed characteristics for insolublization. Preferably, however, the Bk ink is anionic, while the processing liquid is cationic. In addition, to improve the permeability of the processing liquid, a nonionic surfactant is preferably used.

(Embodiment 2)

This embodiment uses a printing method similar to that in the above-described Embodiment 1. Embodiment 2 differs from Embodiment 1 in that the heads for use in ejecting the inks or the processing liquid are of the full-line type.

As described before, the heads each including a relatively large number of ejection openings and thus a large number of heaters are likely to become hot during continuous printing or the like, and this is more significant when the printing duty is high. Consequently, the heads expand and elongate, and a misregistration or a deviation of landing position of the ink and the processing liquid may occur among the heads when they elongate in different manners.

This embodiment prevents the misregistration and ensures the overlapping between the Bk ink and the processing liquid to reliably provide the effects described in Embodiment 1, including the improved OD and so on. That is, the ejection data for the processing liquid is generated in association with the ejection data for the Bk ink. More specifically, increases in respective temperatures of the processing liquid head and the Bk ink head are set so that the misregistration is unnoticeable. A preferable condition is that the ejection data for the processing liquid is identical to that for the Bk ink. This condition allows the Bk ink head and the processing liquid head to elongate in almost the same manner, thereby ensuring the prevention of the misregistration or the like.

SPECIFIC EXAMPLES

Specific examples of the above-described embodiments will be described below with reference to the drawings.

Figure 3:
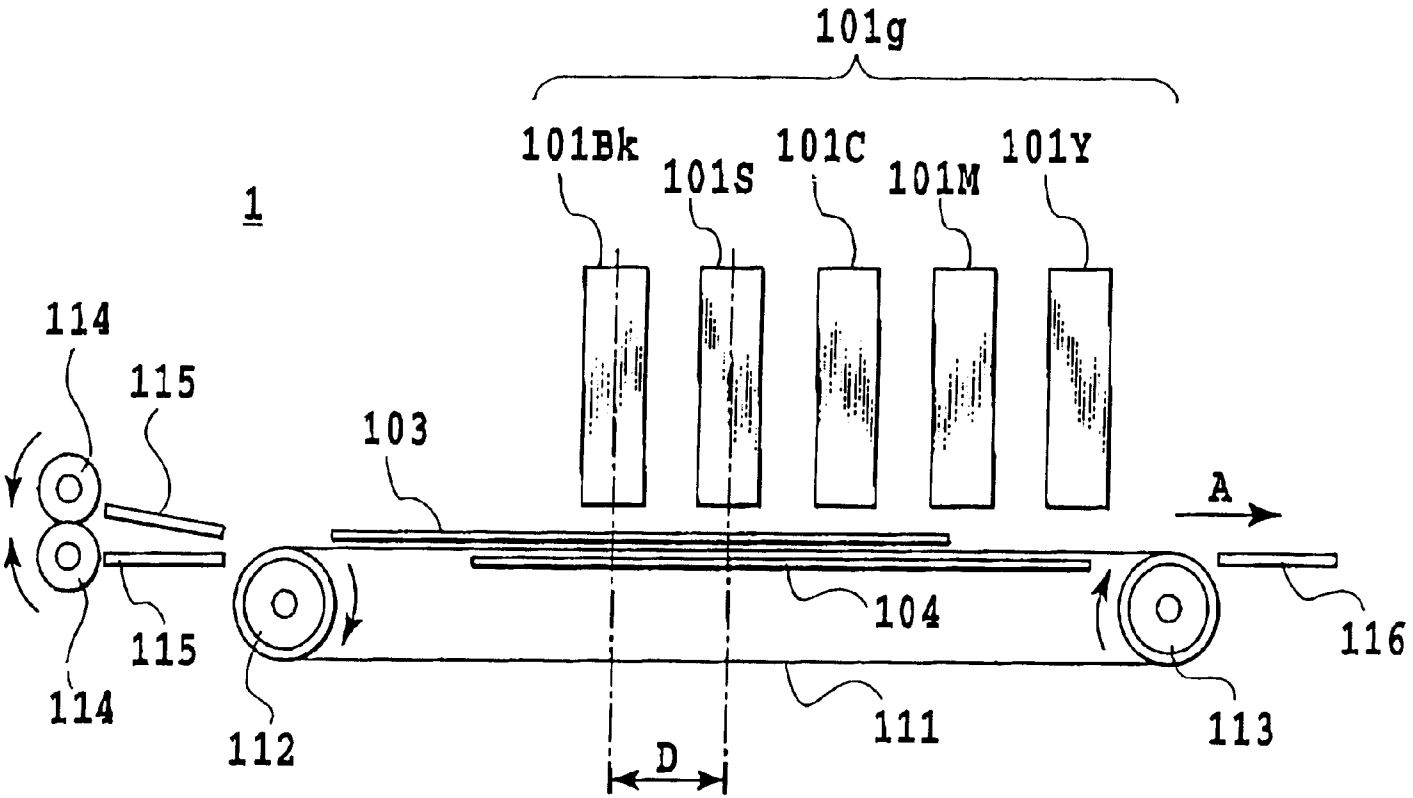
FIG. 3 is a side view showing a general configuration of a printer according to an embodiment of the present invention.

FIG. 3 is a schematic diagram showing a general configuration of a full-line type printing apparatus according to one example of the present invention.

The printing apparatus 1 employs an ink jet printing method of ejecting inks or a processing liquid from a plurality of full-line type print heads located at predetermined positions along a direction (direction shown by an arrow A in the figure) in which printing paper as a printing medium is fed. The printing apparatus 1 operates under the control of a control circuit (not shown).

Print heads 101Bk, 101S, 101C, 101M, and 101Y in a head group 101*g* are of the full-line type described above and each has about 7,200 ink ejection openings arranged in a cross direction (that is perpendicular to the sheet of the drawing) of the printing paper, which is fed in direction A in the figure. Accordingly, these heads enable printing on the printing paper of an A3 size at maximum.

The printing paper 103 is fed in direction A when a pair of resist rollers 114 driven by rotation of a feed motor. The printing paper is guided by a pair of guide plates 115 so as to have its tip registered and is then fed by a conveying belt 111. The conveying belt 111, an endless belt, is held by two rollers 112, 113, and vertical displacement of its upper part is regulated by a platen 104. Rotative driving of the roller 113 causes the printing paper to be conveyed. The printing paper 103 is electrostatically attracted to the conveying belt 111. The roller 113 is rotatively driven by a drive source such as a motor (not shown) in a direction that allows the printing paper 103 to be conveyed in direction A. The printing paper 103 is conveyed on the conveying belt 111 while having images printed thereon by the print head group 101*g*, and is then discharged onto a stocker 116.

Each print head of the print head group 101*g* uses thermal energy to produce a bubble in the ink or the liquid so that pressure of the bubble causes the ink or the liquid to be ejected. The print head group 101*g* has a head 101Bk for ejecting the black (Bk) ink described in the above embodiments and a processing liquid head 101S for ejecting the processing liquid also described in the above embodiments, and further has color ink heads (a cyan head 101C, a magenta head 101M, and a yellow head 101Y) arranged along direction A in which the printing paper 103 is conveyed, as illustrated. The print heads eject the corresponding inks and the processing liquid to enable black characters and color images to be printed.

In this example, the black ink ejected from the head 101Bk has a low permeation speed (such an ink is called as the "remaining upper part-type ink" in this example), whereas the processing liquid and cyan, magenta, and yellow inks ejected from the heads 101S, 101C, 101M, 101Y, respectively have a high permeation speed (such liquid or inks are called as a "highly-permeable inks" in this example).

The permeation speed will be described in brief.

When the permeability of the processing liquid or the ink (hereafter simply referred to as a "liquid") is represented, for example, by volume V per 1 $m^2$, the liquid permeation volume V (in milliliter/$m^2$=$\mu$m) measured as an amount after elapsing time t from ejection of liquid droplets is expressed by the Bristow equation as shown below.

$$V=Vr+Ka(t-tw)^{1/2}$$

where t>tw.

Immediately after the droplets have been landed onto a surface of the printing paper, most of them are absorbed by asperities on the surface (rough portions on the surface of the printing paper) and prevented from permeating through the printing paper. In this case, an amount of time tw (wet time) passes and a volume Vr of the liquid during the time tw is absorbed by the asperities. When the amount of time that has passed after the landing of the droplets exceeds tw, the permeation volume V increases in proportion to the half power of the excess time (t-tw). The above-described Ka is a proportion factor for this increase and corresponds to the permeation speed.

Figure 4:
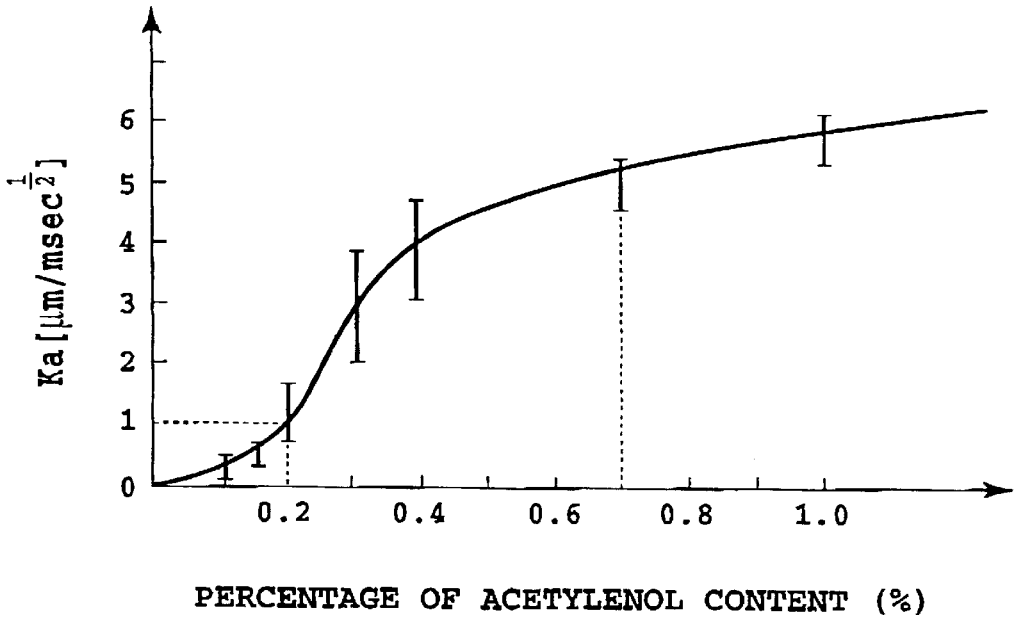
FIG. 4 is a chart showing a relationship between a rate of acetylenol content and a Ka value concerning permeability, according to the above embodiment.

FIG. 4 is a chart showing values of the proportion factor Ka with respect to a rate of acetylenol contained in the liquid as experimentally determined.

The Ka value was measured using a dynamic liquid permeability testing device (manufactured by Toyo Precision Machine Manufacturing Company) based on the Bristow method. This experiment used PB paper from Canon Inc., which is the applicant, as the printing paper. The PB paper can be used both for copiers and LBPs (laser beam printers) using the electro-photographic system and for printers using the ink jet printing system.

Similar results were obtained using PPC paper that is electro-photographic paper available from Canon Inc.

The curve shown in FIG. 4 indicates that the Ka value (shown by an ordinate) increases linearly with increase of the rate of acetylenol content (shown by an abscissa). The proportion factor Ka depends on the rate of acetylenol content. Thus, the ink permeation speed is substantially determined by the rate of acetylenol content. Segments extending parallel with the axis of the ordinate in a fashion crossing the curve indicate ranges of variations in measurement results.

FIGS. 11A and 11B are characteristic diagrams showing the ink permeation volume plotted as a function of the elapsed time; this graph shows results of experiments using the printing paper (PB paper) described above, which was 64 g/$m^2$, 80 $\mu$m in thickness, and about 50% in void percentage.

Figure 5A:
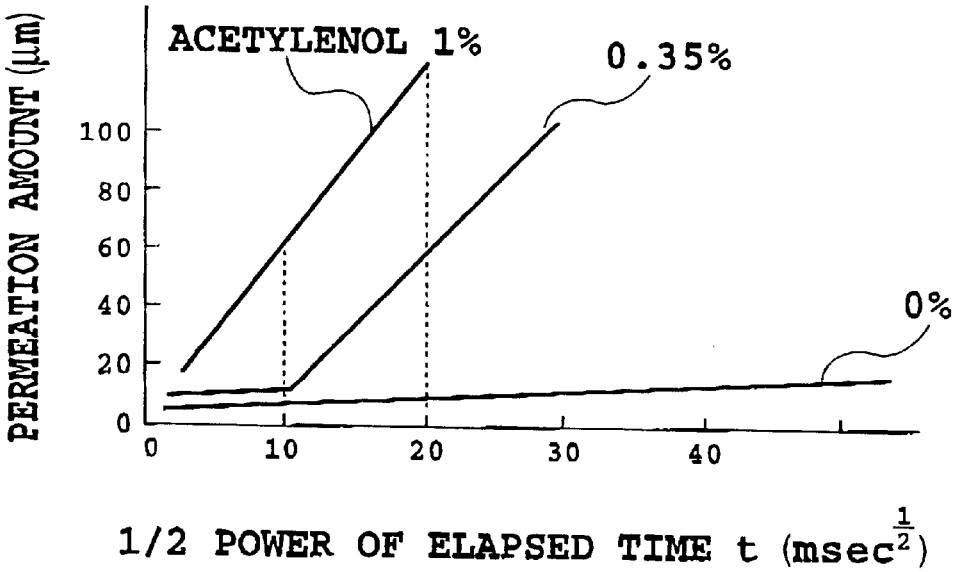
FIGS. 5A and 5B are charts showing an amount of a permeated liquid plotted against a elapsed time after landing of the liquid on a printing medium, wherein the rate of acetylenol content concerning permeability is shown as a parameter.
Figure 5B:
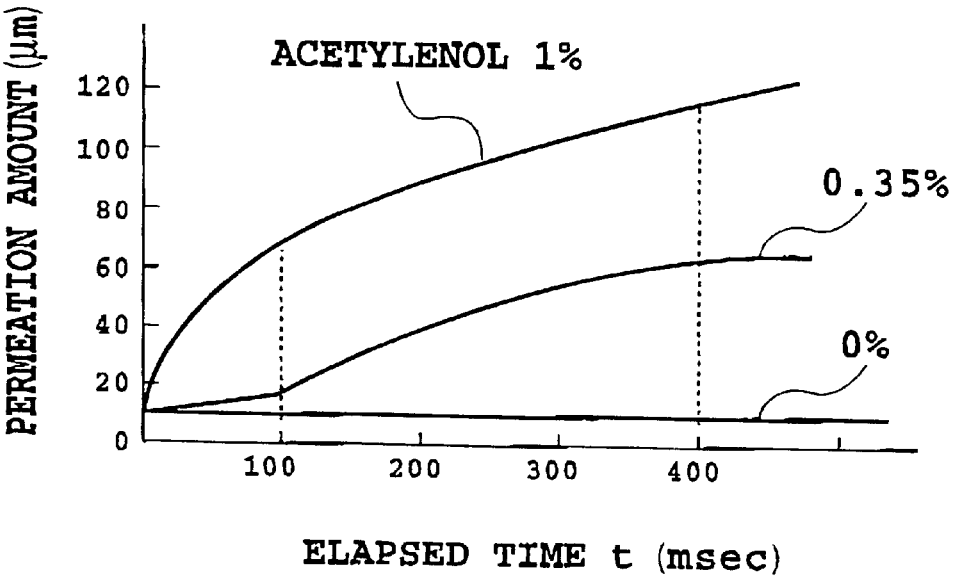

In FIG. 5A, an abscissa indicates a value of the half power of the elapsed time ($msec^{1/2}$), whereas in FIG. 5B, an abscissa indicates the elapsed time t (msec). In both figures, ordinates indicate the permeation volume V ($\mu$m) and the curves indicate the rate of acetylenol content varied between 0 and 0.35 and 1%, respectively.

As is apparent from both figures, the greater the rate of acetylenol content is, the greater the ink permeation volume is with respect to the elapsed time, indicating a higher permeability. The graphs shown in FIGS. 11A and 11B indicate that the wet time tw decreases with an increase in acetylenol content and that the permeability increases linearly with the rate of acetylenol content even before the time tw is reached.

In addition, a liquid free from acetylenol (the acetylenol content is 0%) has a low permeability and exhibits the characteristics of the remaining upper part-type ink, which will be defined later. Additionally, when the liquid has 1% of acetylenol content, it permeates through the printing paper 103 at a high speed and exhibits the characteristics of the highly-permeable ink, which will be defined later. An ink with 0.35% of acetylenol content exhibits the characteristics of a semi-permeable ink, which is an intermediate between the remaining upper part-type ink and the highly-permeable ink.

Table 1 shows the characteristics of the "remaining upper part-type ink" and "highly-permeable ink" described above and of the "semi-permeable ink", which is an intermediate between these inks.

TABLE 1

| | Ka value ($ml/m^2 \cdot msec^{1/2}$) | Acetylenol content (%) | Surface tension (dyne/cm) |
|---|---|---|---|
| Remaining upper part-type ink | Less than 1.0 | Less than 0.2 | 40 or more |
| Semi-permeable ink | 1.0 or more and less than 5.0 | 0.2 or more and less than 0.7 | 35 or more and less than 40 |
| Highly-permeable ink | 5.0 or more | 0.7 or more | Less than 35 |

The above Table 1 shows the Ka value, acetylenol content (%), and surface tension (dyne/cm) of each of the "remaining upper part-type ink", the "semi-permeable ink", and the "highly-permeable ink". The permeability of each ink on the printing paper as a printing medium increases consistently with increasing of the Ka value. That is. it increases when surface tension decreases.

The Ka value in Table 1 was measured using the dynamic liquid permeability testing device (manufactured by Toyo Seiki Seisaku-Sho, Ltd.) based on the Bristow method as described above. This experiment used PB paper from Canon Inc., which is the applicant, as the printing paper. Additionally, similar results were obtained using PPC paper that is electrophotographic paper also available from Canon Inc.

One of the conditions known for mixture of a surfactant into a certain liquid is a critical micelle concentration (CMC) of the surfactant in this liquid. The critical micelle concentration refers to an increased concentration of a solution of the surfactant at which dozens of molecules are associated rapidly with one another to form micelles. The acetylenol, which is contained in the liquid described above to adjust the permeability, is a type of surfactant that has a critical micelle concentration depending on the liquid.

A relationship between the CMC and the surface tension achieved when the acetylenol content is adjusted is such that the surface tension stops decreasing when micelles are formed. Thus, the critical micelle concentration (CMC) of acetylenol in water has been confirmed to be about 0.7%.

A comparison between the critical micelle concentration shown in this figure and the Table 1 above indicates that, for example, the "highly-permeable ink" defined in Table 1 has a acetylenol content larger than the critical micelle concentration (CMC) of acetylenol in water.

The compositions of the processing liquid and inks used in this example are shown below. The rate of each component is shown in terms of parts by weight.

| | |
|---|---|
| [Processing liquid] | |
| Glycerin | 7 pts. wt. |
| Diethylene glycol | 5 pts. wt. |
| Acetylenol EH (manufactured by Kawaken Fine Chemicals Co., Ltd.) | 2 pts. wt. |
| Polyallylamine | 4 pts. wt. |
| Acetic acid | 4 pts. wt. |
| Benzalkonium chloride | 0.5 pts. wt. |
| Water | Remaining part |
| [Yellow (Y) ink] | |
| C.I. direct yellow 86 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Magenta (M) ink] | |
| C.I. acid red 289 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Cyan (M) ink] | |
| C.I. direct blue 199 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Black (M) ink] | |
| Pigment dispersing agent | 25 pts. wt. |
| Food black | 2 pts. wt. |
| Glycerin | 6 pts. wt. |
| Triethylene glycol | 5 pts. wt. |
| Acetylenol EH (manufactured by Kawaken Fine Chemicals Co., Ltd.) | 0.2 pts. wt. |
| Water | Remaining part |

The above pigment dispersing agents will be described below.

[Pigment Dispersing Agents]

A solution was prepared by dissolving 5 g of thick hydrochloric acid in 5.3 g of water, and 1.58 g of anthranilic acid was added to this solution at 5° C. The solution was maintained at 10° C. or lower by means of agitation in an ice bath, and was then mixed with a solution prepared by adding 1.78 g of sodium nitrite to 8.7 g of water at 5° C. Further, after 15 minutes of agitation, 20 g of carbon black having a surface area of 320 $m^2/g$ and a DBP oil absorption of 120 ml/100 g was added to the mixture. Subsequently, the mixture was further agitated for 15 minutes. A slurry thus obtained was filtered using Toyo Filter Paper No. 2 (manufactured by Advantec), pigment particles were washed off, and the slurry was dried in an oven at 110° C. Water was added to this pigment to produce an aqueous solution of pigment containing 10 wt. % of pigment. The above method was used to obtain the pigment dispersing agent containing an anionically charged self-dispersing carbon black having a hydrophilic radical bound thereto via phenyl group as shown in a formula below.

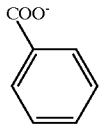

As is apparent from the above compositions, by adjusting the acetylenol content, the black ink is set to be of the remaining upper part-type and the processing liquid and the C, M, and Y inks are set to be of the highly-permeable type.

In addition, the black ink is, what is called, a dispersing agent-free pigment, which has been described in the above example. With this ink, a self-dispersing carbon black dispersant having at least one type of hydrophilic radical bound to a surface thereof directly or via another atomic group is preferably used as the anionic carbon black dispersant. Additionally, the self-dispersing carbon black is preferably ionic and more preferably anionically charged.

In the anionically-charged carbon black, the hydrophilic radical bound to the surface may be, for example. —COOM, —$SO_3M$, —$PO_3HM$, —$PO_3M_2$, —$SO_2NH_2$, or —$SO_2NHOR$ (where M denotes hydrogen atom, alkali metal, ammonium, or organic ammonium, and R denotes an alkyl group with a carbon atom number of 1 to 12, a phenyl radical that may have a substituent, or a naphthyl radical that may have a substituent) In this embodiment, an anionically-charged carbon black having —COOM or —$SO_3M$ bound to its surface is preferable.

Additionally, for the "M" in the hydrophilic radical, the alkali metal may be, for example, lithium, sodium, or potassium, and the organic ammonium may be mono- or tri-methyl ammonium, mono-or tri-ethyl ammonium, or mono- or tri-methanol ammonium. To obtain the anionically-charged carbon black, —COONa may be introduced into the carbon black surface by, for example, oxidizing the carbon black with sodium hypochlorite. Of course, however, the present invention is not limited to this method.

In this embodiment, the carbon black with the hydrophilic radical bound to its surface via another atomic group is preferable. The another atomic group may be, for example, an alkyl group with a carbon atom number of 1 to 12, a phenyl radical that may have a substituent, or a naphthyl radical that may have a substituent). Specific examples of the hydrophilic radical bound to the carbon black surface via the another atomic group include for example, —$CH_4COOM$, —$PhSO_3M$, and —PhCOOM (where Ph denotes a phenyl surface) in addition to those listed above. Of course, the present invention is not limited to these examples.

This dispersing agent-free carbon black is superior to conventional carbon blacks and thus does not require the addition of a pigment dispersing resin or a surfactant. Thus, advantageously, this carbon black is appropriately fixed and wetted and can be reliably used for print heads, compared to conventional pigments.

In this example, each print head has the ink ejection openings arranged therein at a density of 600 dpi and carries out printing at a dot density of 600 dpi in the printing paper feed direction. Accordingly, images or the like printed according to this embodiment have a dot density of 600 dpi both in the row direction and in the column direction. In addition. each head has an ejection frequency of 4 kHz, so that the printing paper is fed at about 170 mm/sec. Furthermore, since a distance D between the Bk ink head 101Bk and the processing liquid head 101S (see FIG. 3) is 40 mm, the time from the Bk ink ejection until the processing liquid ejection is therefor about 0.24 sec.

Furthermore, 80% of the particles in the self-dispersing pigment used in this embodiment preferably have a particle size between 0.05 and 0.3 $\mu$m, and more preferably between 0.1 and 0.25 $\mu$m.

Figure 6:
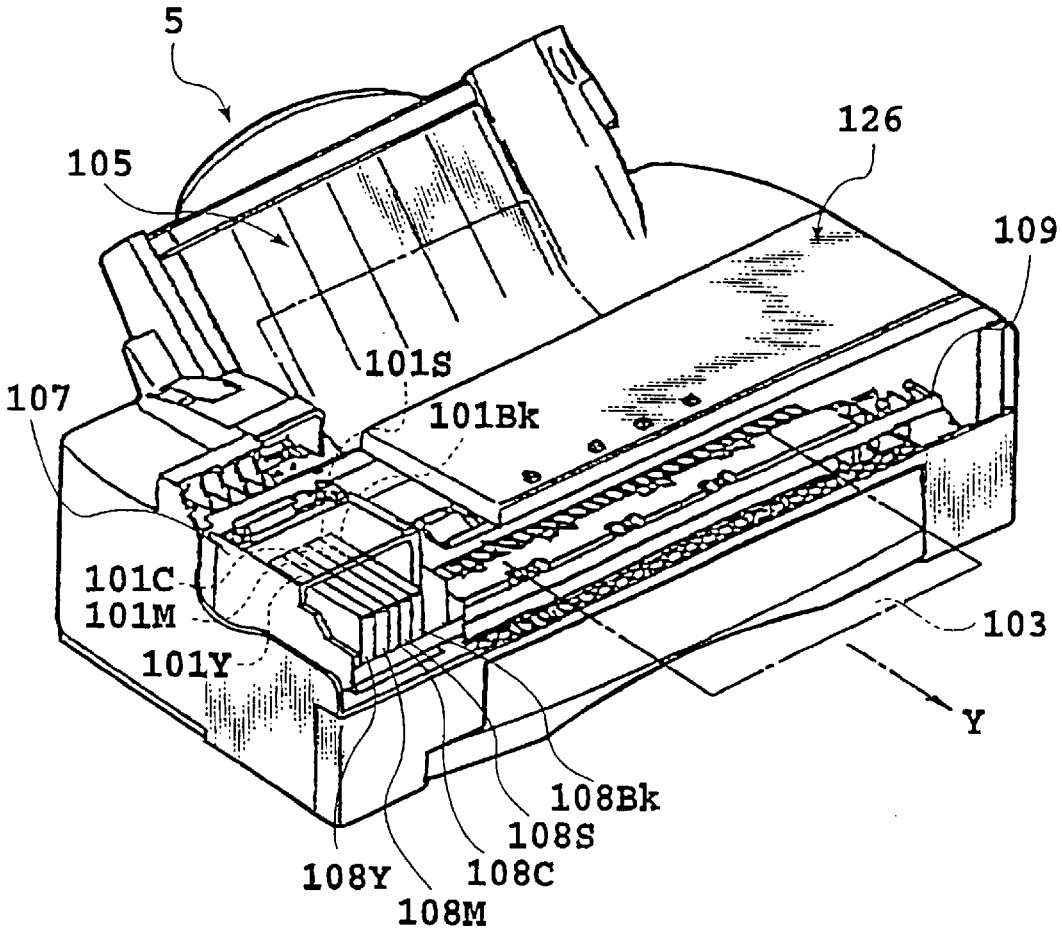
FIG. 6 is a perspective view of a serial printer according to another embodiment of the present invention.

FIG. 6 is a schematic perspective view showing the configuration of a serial printing apparatus 5 according to another example of the present invention. Clearly, the printing apparatus applying the Bk ink to the printing medium and then ejecting the processing liquid for reaction is applicable not only to the above-described full-line type but also to the serial type. The same elements as shown in FIG. 3 carry the same reference numerals and detailed description thereof is omitted.

The printing paper 103, which is the printing medium, is inserted from a paper feed section 105 and discharged through a printing section 126. In this example, common inexpensive plain paper is used as the printing paper 103. In the printing section 126, a carriage 107 mounts the print heads 101S, 101Bk, 101C, 101M, and 101Y and is adapted to reciprocate along a guide rail 109 based on a driving force applied by a motor (not shown). The print head 101S can eject the processing liquid described above in the embodiments. In addition, the black head 101Bk and the heads 101C, 101M, 101Y eject the black ink, the cyan ink, the magenta ink, and the yellow ink, respectively. These heads are driven so that after the black ink and then the processing liquid are ejected, the remaining inks are ejected onto the printing paper 103 in the above order.

Each head is supplied with the processing liquid or the corresponding ink from an ink tank 108Bk, 108S, 108C, 108M, 108Y. For ink ejection, a drive signal is supplied to an electro-thermal converting element (heaters) provided for each the ejection opening of each head to apply thermal energy to the ink or the processing liquid in order to generate bubbles, whereby pressure provided upon bubbling is used to eject the ink or the processing liquid. Each head has 64 ejection openings arranged at a density of 360 dpi in a direction almost the same as a direction Y in which the printing paper 103 is fed, that is, a direction substantially perpendicular to a head scanning direction. And an amount of the inks or the processing liquid ejected from each ejection opening realizes any of the embodiments described above.

In the above configuration, the respective distance between the heads are 1 inch, so that the distance between the heads 101Bk and 101S is 1 inch. Additionally, the print density in the scanning direction is 720 dpi, and the ejection frequency of each head is 7.2 kHz. Accordingly, the time from the Bk ink ejection from the head 101Bk until the processing liquid ejection from the head 101S is 0.05 sec.

Apparent from above description, according to the embodiments of the present invention, the black ink is applied to the printing medium and the processing liquid is then applied so as to mix the black ink and the processing liquid together on the printing medium in a liquid state, and with a timing different from that for the reaction resulting from the mixture of the black ink and the processing liquid, for example, after the reaction, the color inks are applied to an area of the printing medium to which the black ink and the processing liquid are not applied. Thus, a reactant between the black ink and the processing liquid or the black ink becomes insoluble so as to be prevented from flowing out to the peripheries thereof, thereby reducing bleeding at the boundary between a color image and a black image even when the color ink is applied to the peripheries. That is, when before the black ink becomes insoluble, the processing liquid or another ink is applied to the peripheries of the black ink, a liquid which has not become completely insoluble may flow out, but the present invention can prevent such a phenomenon. In addition, when the processing liquid and the color inks are that permeate at a high speed, the black and color images can be printed with high fixing capability.

As a result, fast printing based on fast fixing can be realized, black characters of high density can be printed with little feathering and images can be printed with little bleeding at the boundaries between colors.

The present invention also avoids the misregistration between the inks and the processing liquid to achieve the above-described objects such as high-grade printing.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing method of performing printing by applying to a printing medium, an ink and a processing liquid for making a coloring material in the ink insoluble, said method comprising the steps of:

applying a black ink containing a black coloring material and the processing liquid to the printing medium to mix the black ink and the processing liquid together in a liquid state on the printing medium, and applying a color ink to the printing medium, wherein the processing liquid is not applied to an area to which only the color ink among the color ink and the black ink is applied, and the processing liquid has higher permeability to the printing medium than the black ink has.

2. An ink jet printing method as claimed in claim 1, wherein said step for performing mixing in the liquid state, after applying the black ink and the subsequent processing liquid, further applies the black ink.

3. An ink jet printing method as claimed in claim 1, wherein the timing for applying the color ink is a time after the black ink and the processing liquid is applied.

4. An ink jet printing method as claimed in claim 1, wherein the color ink has higher permeability to the printing medium than the black ink has.

5. An ink jet printing method as claimed in claim 1, wherein the black coloring material includes a dye.

6. An ink jet printing method as claimed in claim 1, wherein the black coloring material includes a pigment.

7. An ink jet printing method as claimed in claim 1, wherein the black coloring material includes a mixture of a dye and a pigment.

8. An ink jet printing method as claimed in claim 1, wherein the black ink is anionic and the processing liquid has a cationic polymer material.

9. An ink jet printing method as claimed in claim 8, wherein the processing liquid has a nonionic surfactant as a material for facilitating permeation.

10. An ink jet printing method as claimed in claim 1, wherein the black ink is applied to the printing medium before the processing liquid is applied.

11. An ink jet printing method as claimed in claim 1, wherein the processing liquid is applied to the printing medium before the black ink is applied.

12. An ink jet printing method as claimed in claim 1, wherein the black ink has a Ka value of less than 1 $ml/m^2 \cdot msec^{1/2}$ and the processing liquid has a Ka value of 5 $ml/m^2 \cdot msec^{1/2}$ or more.

13. An ink jet printing apparatus which uses a head for ejecting an ink and a head for ejecting a processing liquid for making a coloring material in the ink insoluble to perform printing by ejecting to a printing medium the ink and the processing liquid, said apparatus comprising:

ejection control means for ejecting a black ink containing a black coloring material and the processing liquid to the printing medium to mix the black ink and the processing liquid together in a liquid state on the printing medium, and for ejecting a color ink to the printing medium, wherein the processing liquid is not applied to an area to which only the color ink among the color ink and the black ink is applied, and the processing liquid has higher permeability to the printing medium than the black ink has.

14. An ink jet printing apparatus as claimed in claim 13, wherein said ejection control means, after ejecting the black ink and the subsequent processing liquid, further ejects the black ink.

15. An ink jet printing apparatus as claimed in claim 13, wherein the timing for ejecting the color ink is a time after the black ink and the processing liquid is ejected.

16. An ink jet printing apparatus as claimed in claim 13, wherein the color ink has higher permeability to the printing medium than the black ink has.

17. An ink jet printing apparatus as claimed in claim 13, wherein the black coloring material includes a dye.

18. An ink jet printing apparatus as claimed in claim 13, wherein the black coloring material includes a pigment.

19. An ink jet printing apparatus as claimed in claim 13, wherein the black coloring material includes a mixture of a dye and a pigment.

20. An ink jet printing apparatus as claimed in claim 13, wherein the black ink is anionic and the processing liquid has a cationic polymer material.

21. An ink jet printing apparatus as claimed in claim 20, wherein the processing liquid has a nonionic surfactant as a material for facilitating permeation.

22. An ink jet printing apparatus as claimed in claim 13, wherein the head for ejecting the ink and the head for ejecting the processing liquid have a plurality of ejection openings arranged over a range corresponding to a width of the printing medium, respectively.

23. An ink jet printing apparatus as claimed in claim 22, wherein ejection data for the processing liquid is predetermined so as to correlate with ejection data for the black ink so that a deviation between ejection positions on the printing medium provided by corresponding ejection openings in the respective heads for the black ink and the processing liquid is maintained within a predetermined range.

24. An ink jet printing apparatus as claimed in claim 23, wherein the ejection data for the processing liquid is set to be identical to the ejection data for the black ink.

25. An ink jet printing apparatus as claimed in claim 24, wherein the head for ejecting the ink and the head for ejecting the processing liquid use thermal energy to eject the ink and the processing liquid, respectively.

26. An ink jet printing apparatus as claimed in claim 13, wherein the black ink is applied to the printing medium before the processing liquid is applied.

27. An ink jet printing apparatus as claimed in claim 13, wherein the processing liquid is applied to the printing medium before the black ink is applied.

28. An ink jet printing method as claimed in claim 1, wherein a critical micelle concentration of surfactant in the black ink is less than a critical micelle concentration of the surfactant in water, and a critical micelle concentration of surfactant in the respective processing liquid and the color ink is equal to or larger than the critical micelle concentration of the surfactant in water.

29. An ink jet printing method of performing printing by applying to a printing medium, an ink and a processing liquid for making a coloring material in the ink insoluble, said method comprising the steps of:

applying a black ink containing a black coloring material and the processing liquid to the printing medium to mix the black ink and the processing liquid together in a liquid state on the printing medium, and applying a color ink to the printing medium, wherein the processing liquid is not applied to an area to which only the color ink among the color ink and the black ink is applied, and the processing liquid does not comprise coloring material.

30. An ink jet printing apparatus which uses a head for ejecting an ink and a head for ejecting a processing liquid for making a coloring material in the ink insoluble to perform printing by ejecting to a printing medium the ink and the processing liquid, said apparatus comprising:

ejection control means for ejecting a black ink containing a black coloring material and the processing liquid to the printing medium to mix the black ink and the processing liquid together in a liquid state on the printing medium, and for ejecting a color ink to the printing medium, wherein the processing liquid is not applied to an area to which only the coloring ink among the color ink and the black ink is applied, and the processing liquid does not comprise coloring material.

* * * * *

UNITED STATES PATENT AND TRADEMARK OFFICE

CERTIFICATE OF CORRECTION

PATENT NO. : 6,517,191 B1
DATED : February 11, 2003
INVENTOR(S) : Noribumi Koitabashi It is certified that error appears in the above-identified patent and that said Letters Patent is hereby corrected as shown below:

Column 1,
Line 40, “an” should read -- a --.

Column 4,
Lines 2 and 25, “a” should read -- an --.

Column 6,
Line 2, “images.” should read -- images, --.

Column 10,
Lines 21, 27 and 33, “1pts. wt.” should read -- 1 pt. wt. --.

Column 11,
Line 33, “mono-or” should read -- mono– or --.
Line 47, “include” should read -- include, --.

Signed and Sealed this

Fourth Day of November, 2003

JAMES E. ROGAN
*Director of the United States Patent and Trademark Office*